US008951076B2

(12) United States Patent
Tso

(10) Patent No.: US 8,951,076 B2
(45) Date of Patent: Feb. 10, 2015

(54) RECEPTACLE UNIT

(71) Applicant: Chih-Jen Tso, Taichung (TW)

(72) Inventor: Chih-Jen Tso, Taichung (TW)

( * ) Notice: Subject to any disclaimer, the term of this patent is extended or adjusted under 35 U.S.C. 154(b) by 69 days.

(21) Appl. No.: 13/729,185

(22) Filed: Dec. 28, 2012

(65) Prior Publication Data

US 2014/0187102 A1 Jul. 3, 2014

(51) Int. Cl.
*H01R 13/04* (2006.01)
*H01R 13/52* (2006.01)
*H01R 25/00* (2006.01)

(52) U.S. Cl.
CPC ..... *H01R 13/5205* (2013.01); *H01R 25/003* (2013.01)
USPC ..... 439/694

(58) Field of Classification Search
USPC ..... 439/694, 736, 620.22, 502, 644–647, 439/638, 76.1
See application file for complete search history.

(56) References Cited

U.S. PATENT DOCUMENTS

| | | | | |
|---|---|---|---|---|
| 7,052,309 | B1 * | 5/2006 | Chen | 439/484 |
| 7,070,460 | B1 * | 7/2006 | Nagano | 439/736 |
| 7,862,380 | B1 * | 1/2011 | Wang | 439/620.22 |
| 7,950,951 | B2 * | 5/2011 | Mossner et al. | 439/470 |
| 8,007,130 | B2 * | 8/2011 | Wu | 362/249.14 |
| 2002/0020542 | A1 * | 2/2002 | Reiker | 174/53 |

* cited by examiner

*Primary Examiner* — Jean F Duverne
(74) *Attorney, Agent, or Firm* — Charles E. Baxley

(57) ABSTRACT

A receptacle unit includes a body having multiple slots and a wire connection portion is formed to the body. The wire connection portion is exposed from the body and is electrically connected to the slots. A housing is mounted to the wire and connected to the body. The housing is mounted to the wire connection portion to provide electrical isolation to the wire connection portion. Multiple connectors are connected to the body and an isolation member is located to provide isolation to the connectors. Multiple wires are replaceably connected to the connectors.

6 Claims, 4 Drawing Sheets

RECEPTACLE UNIT

FIELD OF THE INVENTION

The present invention relates to a receptacle unit, and more particularly, to a receptacle unit with connectors exposed therefrom so as to be connected with wires to the receptacle.

BACKGROUND OF THE INVENTION

The conventional extension cord assembly generally comprises a receptacle unit and a cable is connected to the receptacle unit so as to provide electric power to the receptacle unit. Multiple slots are defined in the receptacle unit so that multiple appliances can be connected to the receptacle. The cable has a fixed length and a plug is connected to the distal end of the cable so that the receptacle unit can be connected to the city power source or a portable power source at distance.

The receptacle unit and the cable are integrally formed as a one-piece product. The cable accommodates a wire therein and the wire is inserted and fixed to the inside of the receptacle unit. However, once the wire is damaged, even though the receptacle unit is in good condition, the whole extension cord cannot function. This does not meet the economic purposes and generates a lot of plastic and rubber garbage.

The present invention intends to provide a receptacle unit which can be connected with multiple wires, so that the wires can be replaced individually.

SUMMARY OF THE INVENTION

The present invention relates to a receptacle unit and comprises a body having multiple slots and a wire connection portion which is exposed from the body. The wire connection portion is electrically connected to the slots. A wire is connected to the wire connection portion and can be easily accessible and replaced.

A housing is mounted to the wire and connected to the body. The housing is mounted to the wire connection portion to provide electrical isolation to the wire connection portion.

Preferably, the housing has a first securing portion and a second securing portion, wherein the first securing portion is connected to an end of the housing and located away from the body. The first securing portion is cooperated with a securing member to secure the wire with the housing. The second securing portion is located at an intermediate portion of the housing and cooperated with another securing member to secure the connection between the body and the housing.

Preferably, the wire connection portion has a recess and multiple connectors are located at the inside of the recess. The connectors are electrically isolated from each other. The connectors each have a connection hole which is located outside of the recess so that wires can be easily connected to the holes of the connectors.

Preferably, an isolation member is located in the body and extends beyond the recess so as to isolate the connectors.

The wires are exposed from the body so that they can be easily accessed, maintained and replaced.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
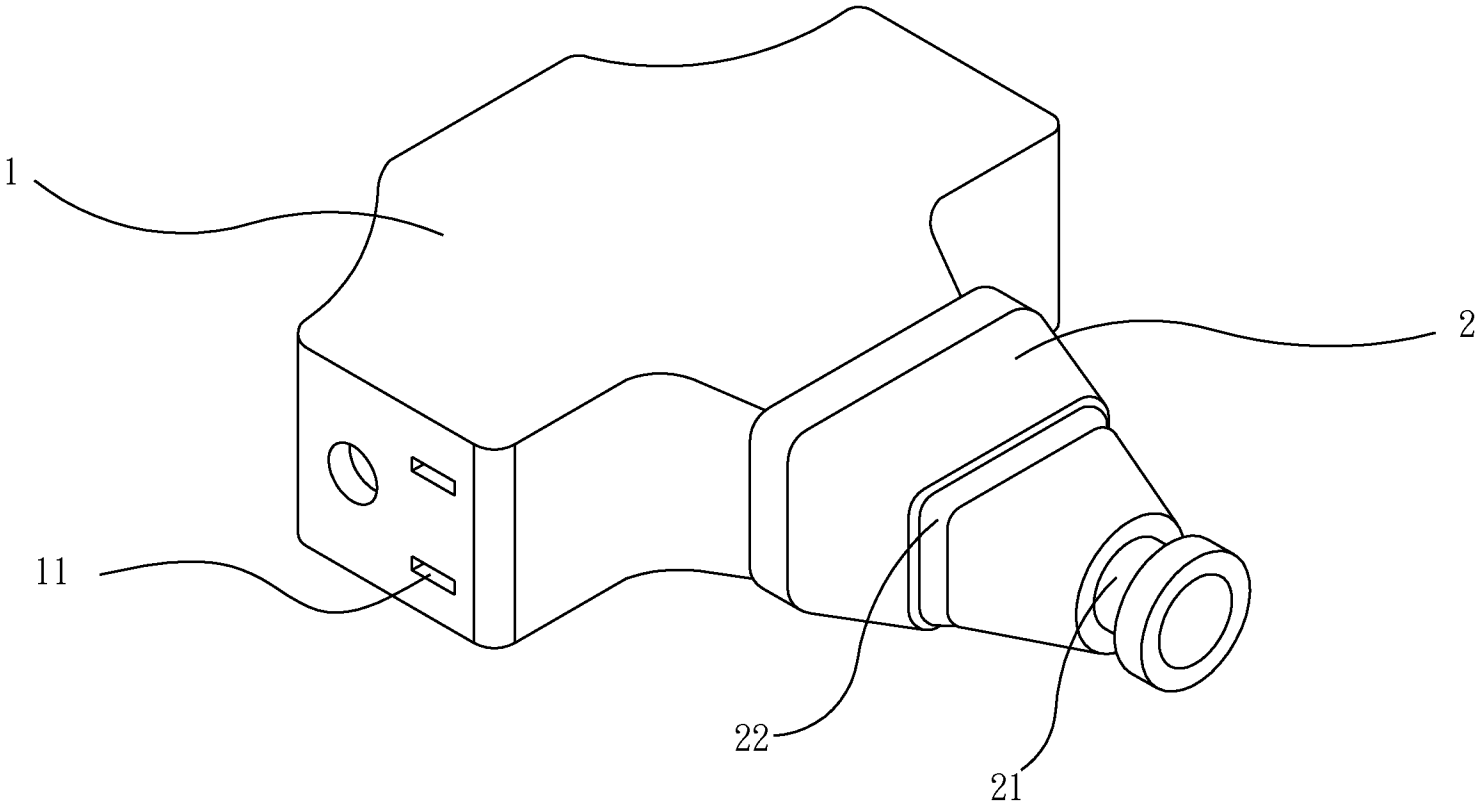
FIG. 1 is a perspective view to show the receptacle unit of the present invention.
Figure 2:
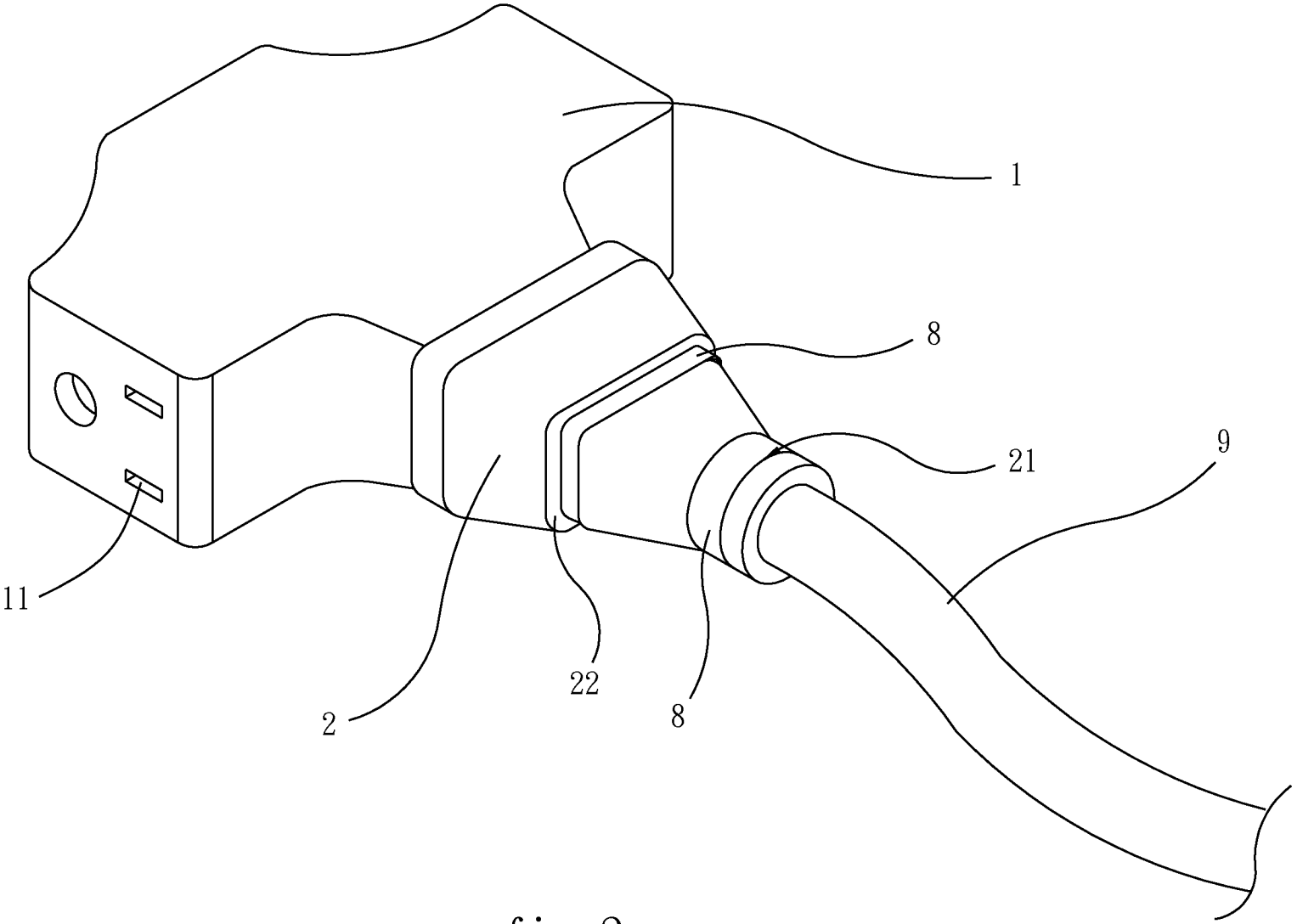
FIG. 2 is a perspective view to show that a wire is connected to the receptacle unit of the present invention.
Figure 3:
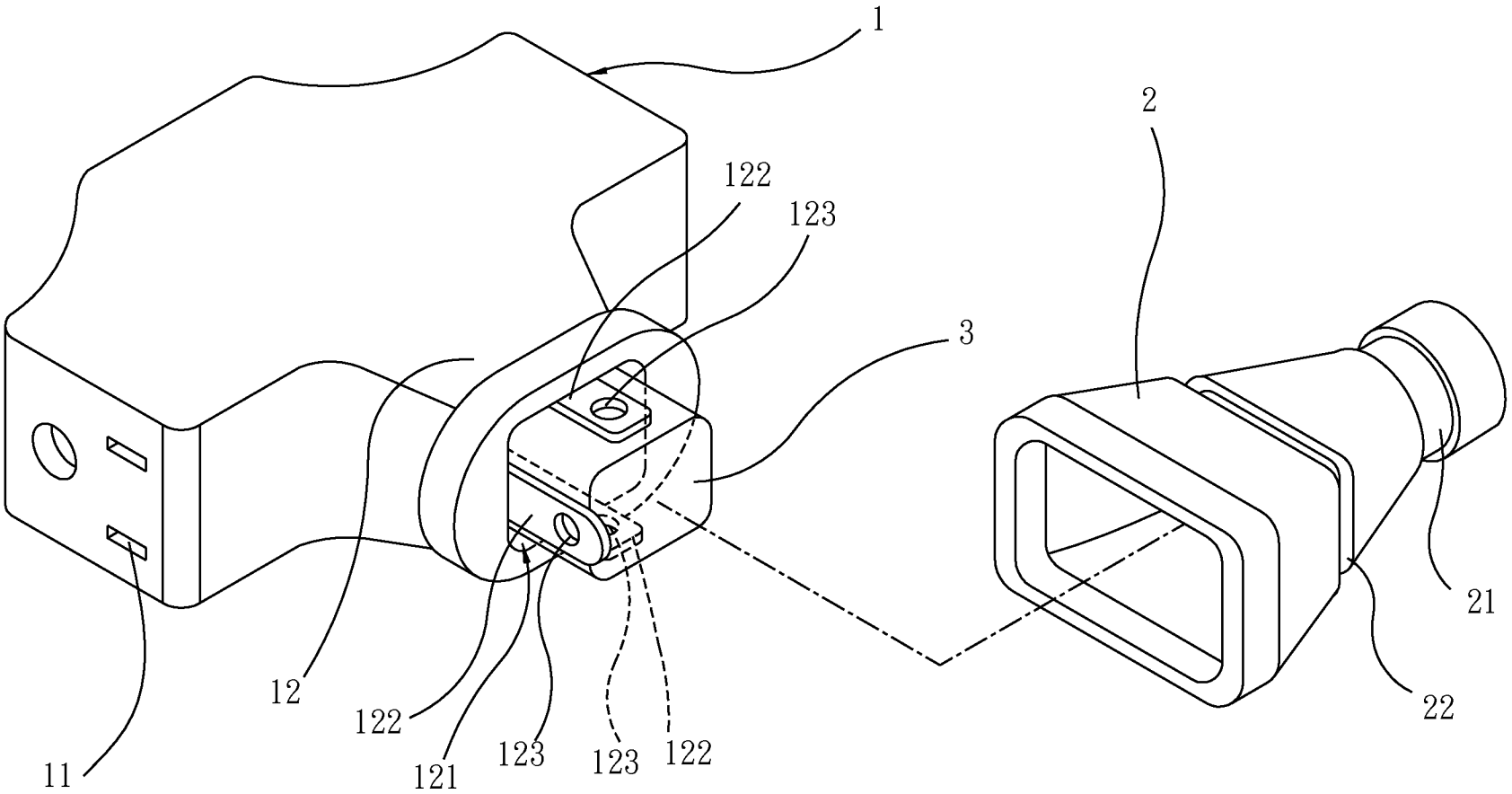
FIG. 3 is an exploded view to show the receptacle unit of the present invention.

Referring to FIGS. 1 to 3, the receptacle unit of the present invention comprises a body 1 and a housing 2. The body 1 has multiple slots 11 and a wire connection portion 12 which is formed to the body 1 and exposed from the body 1. The wire connection portion 12 is electrically connected to the slots 11. A wire 9 is connected to the wire connection portion 12 so that when blades of a plug are inserted into the slots 11, the electric power is transferred to the appliance of the plug.

The housing 2 is mounted to the wire 9 and connected to the body 1. The housing 2 is mounted to the wire connection portion 12 to provide electrical isolation to the wire connection portion 12. The wire has one end connected to the wire connection portion 12 and the other end of the wire 9 extends from the housing 2. The housing 2 protects the wire connection portion 12 and provide electrical isolation to the wire connection portion 12.

The housing 2 has a first securing portion 21 which is connected to one end of the housing 2 and located away from the body 1. The first securing portion 21 is cooperated with a securing member 8 (FIG. 2) to secure the wire 9 with the housing 2. The wire 9 is not shifted and pulled and separated from the wire connection portion 12. A securing portion 22 is located at the intermediate portion of the housing 2 and cooperated with another securing member 8 to secure the connection between the body 1 and the housing 2.

In the conventional extension cord, the wire is integral to the receptacle by way of plastic injection molding so that when the wire is damaged, the whole extension cord has to be discarded. For the receptacle unit of the present invention, the wire connection portion 12 is exposed from the body 1 so that the wires can be easily accessed, maintenance and replaced.

The wire connection portion 12 has a recess 121 and multiple connectors 122 are located at the inside of the recess 121. The connectors 122 are electrically isolated from each other. The connectors 122 each have a connection hole 123 which is located outside of the recess 121. The wires 9 can be easily connected to the holes 123 and at least one of the connectors 122 is a ground connector which is connected to a ground wire.

An isolation member 3 is located in the body 1 and extends beyond the recess 121 so as to isolate the connectors 122. The length that the isolation member 3 extends from the body 1 is at least the same as the connectors. When the wires 9 are connected to the holes 123 of the connectors 122, the wires 9 are further secured to the isolation member 3.

Figure 4:
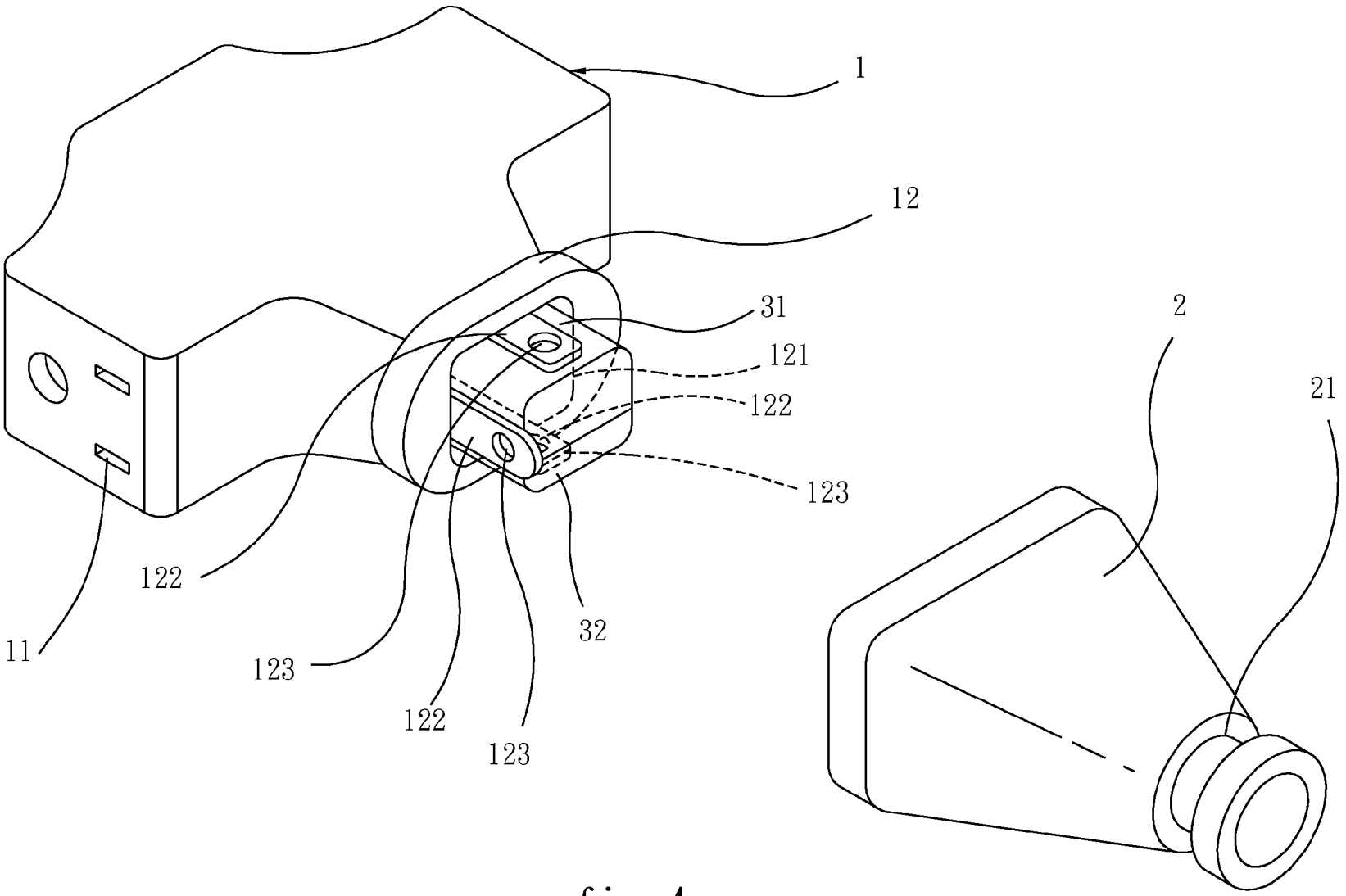
FIG. 4 is a perspective view to show the second embodiment of the receptacle unit of the present invention.

As shown in FIG. 4, the second embodiment of the isolation member 3 is composed of a first isolation piece 31 and a second isolation piece 32. The first isolation piece 31 is overlapped on the second isolation piece 32. The first isolation piece 31 and the second isolation piece 32 are inserted into the body 1 and extend beyond the recess 121.

The advantage of the present invention is that the wires 9 can be easily maintenance and replaced so that the receptacle unit of the present invention functions as desired by replacing the damaged wires 9.

While we have shown and described the embodiment in accordance with the present invention, it should be clear to those skilled in the art that further embodiments may be made without departing from the scope of the present invention.

What is claimed is:

1. A receptacle unit comprising:

a body having multiple slots, a wire connection portion formed to the body and exposed from the body, the wire connection portion being electrically connected to the slots, the wire connection portion having a recess and multiple connectors located at an inside of the recess, an isolation member located in the body and extending beyond the recess, the connectors being electrically isolated from each other by the isolation member, a wire connected to the wire connection portion, and a housing mounted to the wire and connected to the body, the housing mounted to the wire connection portion to provide electrical isolation to the wire connection portion.

2. The unit as claimed in claim 1, wherein the connectors each have a connection hole which is located outside of the recess.

3. The unit as claimed in claim 1, wherein at least one of the connectors is a ground connector.

4. The unit as claimed in claim 1, wherein the isolation member is composed of a first isolation piece and a second isolation piece, the first isolation piece is overlapped on the second isolation piece, the first isolation piece and the second isolation piece are inserted into the body and extend beyond the recess.

5. The unit as claimed in claim 1, wherein the housing has a first securing portion which is connected to an end of the housing and located away from the body, the first securing portion is cooperated with a securing member to secure the wire with the housing.

6. The unit as claimed in claim 5, wherein the housing has a second securing portion which is located at an intermediate portion of the housing, the second securing portion is cooperated with another securing member to secure the connection between the body and the housing.

* * * * *